US005760806A

United States Patent [19]

Oda et al.

[11] Patent Number: 5,760,806

[45] Date of Patent: Jun. 2, 1998

[54] INK SUPPLY DEVICE INK JET PRINTER AND INK SUPPLY METHOD

[75] Inventors: Kazuyuki Oda; Junichi Yoshida; Jun Takagi; Yoshihiko Fujimura, all of Kanagawa, Japan

[73] Assignee: Fuji Xerox Co., Ltd., Tokyo, Japan

[21] Appl. No.: 887,263

[22] Filed: Jul. 2, 1997

Related U.S. Application Data

[63] Continuation of Ser. No. 276,930, Jul. 19, 1994, abandoned.

[30] Foreign Application Priority Data

Jul. 20, 1993 [JP] Japan ..... 5-201090
Jul. 20, 1994 [JP] Japan ..... 6-167637

[51] Int. Cl.[6] ..... B41J 2/175

[52] U.S. Cl. ..... 347/87

[58] Field of Search ..... 347/85–87, 93

[56] References Cited

U.S. PATENT DOCUMENTS

| | | | |
|---|---|---|---|
| 3,967,286 | 6/1976 | Andersson et al. | 347/87 |
| 4,719,479 | 1/1988 | Kyogoko . | |
| 4,994,824 | 2/1991 | Winslow | 347/85 |
| 5,409,138 | 4/1995 | Nakano | 347/85 |

FOREIGN PATENT DOCUMENTS

| | | | |
|---|---|---|---|
| 493058 | 7/1992 | European Pat. Off. | 347/87 |
| 3640032 | 5/1988 | Germany | 347/87 |
| 12351 | 1/1986 | Japan | 347/93 |
| 62-231759 | 10/1987 | Japan . | |
| 283456 | 11/1990 | Japan | 347/87 |
| 3-180357 | 8/1991 | Japan . | |
| 110157 | 4/1992 | Japan | 347/93 |
| 4-296566 | 10/1992 | Japan . | |
| 104735 | 4/1993 | Japan | 347/86 |
| 615839 | 1/1994 | Japan | 347/85 |

*Primary Examiner*—N. Le
*Attorney, Agent, or Firm*—Finnegan, Henderson, Farabow, Garrett & Dunner, L.L.P.

[57] ABSTRACT

An ink supply device for use in an ink jet printer comprising a main ink chamber in communication through a communication hole with a sub-ink chamber containing an ink absorbing member therein. A meniscus film forming member covering the communication hole and communicating the main ink chamber with the sub-ink chamber; the member having a first surface facing the interior of the main ink chamber and an opposite second surface. An ink guide member extending into a lower portion of the main chamber and also being in contact with the first surface of the film forming member, wherein as ink in the main ink chamber is consumed a differential pressure between the first and second surfaces of the film forming member causes a gradual expansion of a liquid meniscus film into an air bubble on the film forming member to maintain a constant negative pressure in the main ink chamber.

7 Claims, 10 Drawing Sheets

INK SUPPLY DEVICE INK JET PRINTER AND INK SUPPLY METHOD

This application is a continuation of application Ser. No. 08/276,930, filed Jul. 19 1994, now abandoned.

BACKGROUND OF THE INVENTION

1. Field of the Invention

The present invention relates to an ink supply device used to supply ink to a record head in an ink jet printer.

2. Description of the Related Art

An ink jet printer jets out ink from a record head to thereby achieve recording. The record head includes an ink passage and an ink jet port and, a heater is provided in the middle portion of the ink passage. If the heater generates heat, then air bubbles are produced and the pressures of the produced air bubbles cause ink to be jetted out, thereby achieving recording. After the ink is jetted out, the air bubbles disappear and negative pressures rate generated in the ink passage and in an ink tank. The negative pressures cause the ink tank to supply therefrom an amount of ink corresponding to the amount of the ink jetted. Also, in the record head, when the ink has been supplied to the ink jet port but no recording is in operation, in order to prevent the ink from leaking from the ink jet port, the ink tank side thereof is held slightly negative in pressure. In this case, if the pressure of the interior of the ink tank is too low, air enters rom the ink jet port, which results in poor ink jetting. Therefore, in the ink jet printer, it is necessary to keep the interior of the ink tank always in a suitable negative pressure.

Conventionally, in the ink jet printer, as a device which is used to keep an ink tank in a negative pressure condition, there is known an ink supply device which is disclosed in Japanese Patent Publication No 3-180357 of Heisei and the like. In this conventional ink supply device, a closed ink tank is filled with ink and a small hole with one end thereof opened to the air is formed in the ink tank. According to the ink supply device, the surface tension of the ink formed in the small hole is used to keep the negative pressure. In other words, if the negative pressure within the ink tank increases as the ink within the ink tank is consumed, the air is conducted into the ink tank through the small hole to thereby keep the negative pressure within the ink tank in an almost constant level.

SUMMARY OF THE INVENTION

It is an object of the invention to provide an ink supply device which can keep the negative pressure within an ink chamber in an almost constant level and can stably supply ink within the ink chamber to a record head by use of a different method from the conventional method.

In attaining the above object, according to a first aspect of the invention, there is provided an ink supply device for use in an ink jet printer which supplies ink to a record head to thereby execute recording, the ink supply device including an ink chamber for storing ink therein, a meniscus forming portion provided in part of the wall of the ink chamber and having a large number of minute holes, and a liquid guide portion for supplying liquid to the meniscus forming portion, wherein the pressure of the interior of the ink chamber can be adjusted by means of menisci which are respectively formed in the minute holes included in the meniscus forming portion by the liquid supplied from the liquid guide portion.

Also, according to a second aspect of the invention, in the ink supply device as constituted in the first aspect of the invention, in which the liquid guide portion is in contact with the surface of the meniscus forming portion at the ink chamber side thereof, and extends into ink to supply ink stored in the ink chamber to the meniscus forming portion.

Further, according to a third aspect of the invention, there is provided an ink supply device in an ink jet printer which supplies ink to a record head to thereby execute recording, the ink supply device including: a main ink chamber for storing ink therein; a sub-ink chamber disposed over the main ink chamber, in communication with the main ink chamber through a communication hole, and including an air communication port; an ink absorbing member disposed within the sub-ink chamber; a meniscus forming portion provided so as to cover the communication hole and including a large number of minute holes; and, an ink guide portion in contact with the surface of the meniscus forming portion at the main ink chamber side thereof, extending into ink stored in the main ink chamber, and arranged to supply the ink to the meniscus forming portion.

According to a fourth apsect of the invention, in the ink supply device as constituted in the second or third aspect of the invention, the meniscus forming portion and the liquid guide portion or the ink guide portion are formed of the same material.

According to a fifth aspect of the invention, there is provided an ink supply device for use in an ink jet printer which supplies ink to a record head to thereby execute recording, the ink supply device including: a main ink chamber for storing ink therein; a sub-ink chamber disposed adjoining the main ink chamber and including an air communication port; an ink absorbing member disposed within the sub-ink chamber; and, a meniscus forming portion disposed in a partition wall between the sub-ink chamber and the main ink chamber and including a large number of minute holes.

According to a sixth aspect of the invention, in the ink supply device as constituted in the fifth aspect of the invention, there is further included an ink guide portion which is in contact with the surface of the meniscus forming portion at the main ink chamber side thereof and supplies the ink in the main ink chamber to the meniscus forming portion.

According to a seventh aspect of the invention, in the ink supply device as constituted in any of the first to sixth aspects of the invention, the minute holes of the meniscus forming portion are formed such that the sum of the interfacial tension of a meniscus film formed in the meniscus forming portion and a pressure head caused by a level difference between a nozzle provided in the record head and the liquid surface of the ink in the ink chamber is smaller than the surface tension of ink existing at the leading end portion of the nozzle.

According to an eighth aspect of the invention, in the ink supply device as constituted in any of the first to seventh aspects of the invention, the meniscus forming portion is formed of a mesh member having a twilled Dutch weave structure.

According to a ninth aspect of the invention, there is provided an ink supply device for use in an ink jet printer which supplies ink to a record head to thereby execute recording, the ink supply device including: a main ink chamber for storing ink therein; a sub-ink chamber including an air communication port; and, an ink absorbing member disposed within the sub-ink chamber and including a high density portion in part of the surface thereof, wherein the sub-ink chamber and the main ink chamber are connected in communication with each other through the high density portion of the ink absorbing member, and a meniscus film is formed in the high density portion.

According to a tenth aspect of the invention, in the ink supply device as constituted in the ninth aspect of the invention, there is further included an ink guide portion which is in contact with the high density portion of the ink absorbing member and supplies the ink in the main ink chamber to the meniscus forming portion.

According to an eleventh aspect of the invention, there is provided an ink jet printer which supplies ink to a record head to thereby execute recording, the ink jet printer including the ink supply device as set forth in any of the first to tenth aspects of the invention.

According to the twelfth aspect of the invention, there is provided an ink supply method used in an ink supply device which includes a closed ink chamber for storing ink therein and a member disposed in part of the wall of the ink chamber for forming a liquid meniscus film, in which one surface of the meniscus film is open to the ambient pressure of the ink supply device, the other surface thereof is in communication with the air of the ink chamber, whereby as the ink is decreased to thereby increase a differential pressure acting on the meniscus film, the meniscus film gradually increases its projecting shape towards the ink chamber and finally turns into a liquid film with air contained therein, and the liquid film with air goes into the ink chamber and forms its original meniscus film, so that the differential pressure within the ink chamber is decreased by an amount corresponding to an amount of air carried into the ink chamber to thereby be able to keep the negative pressure of the interior of the ink chamber in a constant level.

In the first aspect of the invention, liquid is always supplied from the liquid guide portion to the meniscus forming portion provided in part of the wall of the ink chamber and a liquid film is formed in the minute holes of the meniscus forming portion. The meniscus liquid film is used to adjust the pressure of the interior of the ink chamber. In other words, when the pressure of the interior of the ink chamber is lowered, then the meniscus is pushed by the air and the air is allowed to go into the ink chamber to turn into air bubbles. The air is further combined with the air in the ink chamber to increase the volume of the interior of the ink chamber, thereby raising the pressure of the interior of the ink chamber. After the air bubbles are produced, a new liquid film is formed again in the minute holes of the meniscus forming portion to thereby be able to keep the pressure balance due to the meniscus.

Also, in the second aspect of the invention, ink is used as the liquid, and the ink stored in the ink chamber is absorbed up by the liquid guide portion and is then supplied to the meniscus forming portion. Thanks to this, the meniscus forming portion can be always kept wet without using special liquid to form a meniscus film.

Further, in the third aspect of the invention, the meniscus forming portion is provided between the sub-ink chamber having the ink absorbing member and the main ink chamber. While the ink is not in use, the present invention is able to fill the ink in such an amount as enables the main ink chamber and the ink absorbing member of the sub-ink chamber to hold the ink, thereby being able to improve the filling efficiency of the ink. In this state, the ink is held by means of the capillary force of the ink absorbing member and, therefore, the ink is prevented from overflowing from the air communication port. When the ink is in use, the ink stored in the sub-ink chamber is firstly used and the negative pressure is kept by the ink absorbing member. When the ink in the sub-ink chamber is used up, the meniscus forming portion is always kept wet with ink due to a similar action to that provided by the structure as consitituted in the second aspect of the invention, so that the negative pressure within the main ink chamber can be maintained substantially in a constant level. Also, if the environment varies and thus the air within the main ink chamber is expanded, then the ink is absorbed up by the ink absorbing member through the ink guide portion. Due to this, even if the environment varies, the negative pressure within the main ink chamber can be maintained almost in a constant level.

According to the fourth aspect of the invention, the meniscus forming portion and the liquid guide portion or ink guide portion can be formed of the same material. This can reduce the number of parts and the man-hour for assembling, thereby being able to reduce the cost.

According to the fifth aspect of the invention, the main ink chamber and sub-ink chamber are so located as to adjoin each other and the meniscus forming portion is provided in the partition wall between the main and sub-ink chambers. If the ink is used, then the ink in the sub-ink chamber is firstly moved into the main ink chamber to reduce the negative pressure of the interior of the main ink chamber. Further, if the negative pressure in the main ink chamber is increased, then the air is guided into the main ink chamber through the meniscus forming portion, thereby maintaining the negative pressure in an almost constant level. While the air is being guided in the upper portion of the meniscus forming portion, the lower portion of the meniscus forming portion is present within the ink, and the meniscus forming portion itself absorbs up the ink, that is, it performs a similar function to the ink guide portion. Therefore, the meniscus forming portion is always kept wet with the ink and thus the negative pressure in the main ink chamber can be maintained in an almost constant level.

According to the sixth aspect of the invention, since the ink guide portion is so provided as to be in contact with the surface of the meniscus forming portion at the main ink chamber side thereof, for example, even when the ink supply device is disposed such that the meniscus forming portion is located above the main ink chamber and also the whole surface of the meniscus forming portion at the main ink chamber side thereof is exposed to the air, the ink in the main ink chamber is supplied to the meniscus forming portion by the ink guide portion in the main ink chamber. Therefore, no matter how the ink supply device is placed, the meniscus forming portion can be always kept wet and the negative pressure within the main ink chamber can be maintained in an almost constant level.

According to the seventh aspect of the invention, the minute holes of the meniscus forming portion are formed in such a manner that the sum of the interfacial tension of a meniscus film to be formed in the meniscus forming portion and the pressure head caused by a height difference between a nozzle provided in a record head and the liquid surface of the ink in the ink chamber is smaller than the surface tension of the ink in the leading end portion of the nozzle. This can keep the negative pressure in a suitable level, prevents ink leakage or the like, and allows the ink to be moved toward the nozzle to thereby be able to form a good recording image without taking in the air from the nozzle leading end portion.

According to the eighth aspect of the invention, the meniscus forming portion can be formed of a mesh-shaped member having a twilled Dutch weave structure. With use of the twilled Dutch weave, uniform meshes can be provided and the pressure adjustment by means of a meniscus film to be formed in the meshes can be made with high precision. Further, since the twilled Dutch weave allows the ink to be moved to the meshes rapidly, even if the meniscus is caused to project excessively toward the ink chamber and to be ruptured, a new meniscus will be formed immediately to thereby be able to prevent troubles such as the removal of the negative pressure and the like.

According to the ninth aspect of the invention, a high density portion is formed in part of the surface of an ink absorbing member disposed within the sub-ink chamber, and the sub-ink chamber and main ink chamber connected in communication with each other by means of the high density portion. The high density portion can be used as the meniscus forming portion and, by forming a meniscus film in the high density portion, it is possible to perform such ideal negative pressure control as described above. That is, according to the present invention, there is provided a structure that the ink absorbing member and meniscus forming portion are formed integrally with each other. This structure can reduce the number of parts and can also reduce the cost.

According to the tenth aspect of the invention, an ink guide portion is additionally provided in the structure as constituted in the ninth aspect of the invention. Therefore, the present invention functions similarly to the sixth aspect of the invention and can provide similar effects to the same.

According to the eleventh aspect of the invention, there is provided an ink jet printer which carries the ink supply device as constituted in any of the first to tenth aspects of the invention. Therefore, ink can be supplied to a record head quite well due to a suitable negative pressure, which makes it possible to provide a record image of high quality with less poor recording.

According to the twelfth aspect of the invention, in order to keep the negative pressure within the ink chamber in a constant level, there is used a liquid meniscus film. One surface of the meniscus film is open to the ambient pressure of the ink supply device, while the other surface thereof is exposed to the air of the ink chamber. In this state, if the ink in the ink chamber is reduced, then a differential pressure acting on the meniscus film is increased, the meniscus film is caused to gradually enlarge its projecting shape toward the ink chamber and finally to turn into a liquid film containing air therein, before it enters the ink chamber. The air guided into the ink chamber works so as to reduce the differential pressure in the ink chamber, thereby being able to keep the negative pressure in the ink chamber in a constant level.

The above and other objects and features of the present invention will be more apparent from the following description taken in conjunction with the accompanying drawings.

DETAILED DESCRIPTION OF THE PREFERRED EMBODIMENTS

Figure 1A:
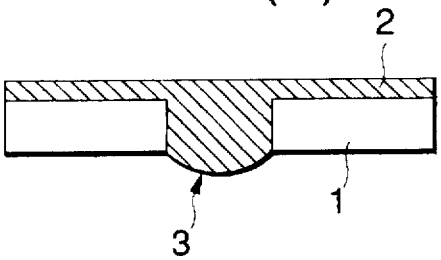
FIGS. 1(A) to 1(G) are explanatory views of the principle of the operation of an ink supply device according to the invention.

FIGS. 1(A) to 1(G) are explanatory views of the principle of the operation of an ink supply device according to the invention. In FIGS. 1(A) to 1(G), reference character 1 designates a meniscus forming portion, 2 stands for liquid, and 3 represents a hole. The meniscus forming portion 1 includes one or more minute holes 3. In FIGS. 1(A) to 1(G), only one hole 3 is shown. However, this is not limitative but two or more holes 3 may be formed. In the hole 3, a liquid film is formed of the liquid 2 supplied to the meniscus forming portion 1. When the same pressure is applied to the two surfaces of the meniscus forming portion 1, as shown in FIG. 1(A), the liquid film formed in the hole 3 provides a meniscus which is slightly expanded outwardly.

Figure 1B:
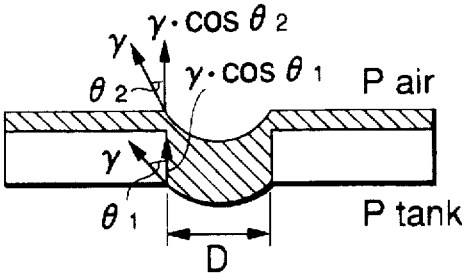

In FIG. 1(B), there is shown a state in which the meniscus forming portion 1 is mounted in an ink chamber and a negative pressure within the ink chamber is balanced with the atmospheric pressure. In FIG. 1(B), the upper side stands for the atmospheric pressure, while the lower side shows the interior of the ink chamber. When the ink stored in the ink chamber is consumed and the pressure of the interior of the ink chamber becomes negative when compared with the atmospheric pressure, then the film of the liquid 2 formed in the hole 3 is pushed from the atmospheric side to the ink chamber side, so that the meniscus of the liquid 2 provides a shape that projects into the ink chamber side. At that time, there is generated a force to return the meniscus back to its original condition, that is, a force to move the projected meniscus back to the atmospheric side due to the surface tension of the liquid 2, so that the meniscus of the liquid 2 is turned into a balanced condition.

Now, when the atmospheric pressure is expressed as Pair, the pressure of the interior of the ink chamber as Ptank, an interfacial tension in a boundary surface between the liquid 2 and meniscus forming portion 1 as $\gamma$, the density of the liquid 2 as $\rho$, a wetting angle at the atmospheric side as $\theta 2$, a wetting angle at the ink chamber side as $\theta 2$, the diameter of the hole 3 as D, and the acceleration of gravity as g, then a pressure P1 due to the interfacial tension can be given by the following equation:

$$P1=4\gamma\cdot\cos\theta1/D+4\gamma\cdot\cos\theta2/D$$

Here, if approximating as $\theta1=\theta2=\theta$, then the above equation can be expressed as follows:

$$P1=8\gamma\cdot\cos\theta/D$$

Also, the pressure difference of the interface P2 can be obtained according to the following equation:

$$P2=Pair-Ptank$$

Because P1=P2 in an equilibrium condition, the ink chamber pressure can be obtained according to the following equation:

$$Ptank=Pair-8\gamma\cdot\cos\theta/D \quad \text{(equation 1)}$$

Figure 1C:
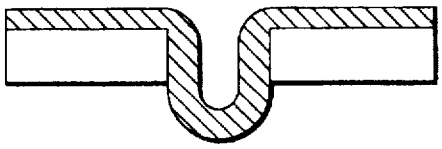
Figure 1D:
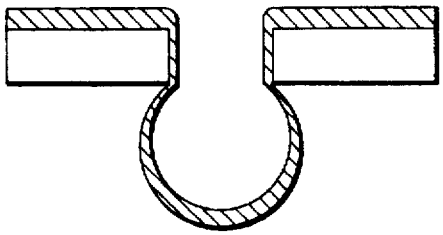
Figure 1E:
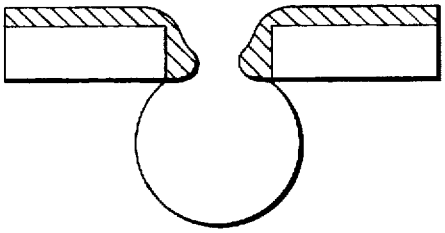
Figure 1F:
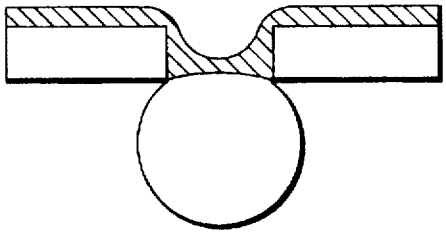

As can be understood from the equation 1, according to the negative pressure in the ink chamber, an equilibrium condition is obtained when the wetting angle θ is reduced according to the negative pressure in the ink chamber. In other words, if the negative pressure in the ink chamber is increased, then the shape of the liquid projecting to the ink chamber side is gradually enlarged, as shown in FIGS. 1(C), 1(D) and 1(E). If the negative pressure in the ink chamber is further increased, then as shown in FIG. 1(F), a film of the liquid is formed again in the portion of the hole 3 and the projecting portion turns into a bubble. Formation of the bubble increases the volume of the ink chamber by an amount corresponding to the air contained in the bubble, thereby reducing the negative pressure in the ink chamber accordingly. In this manner, the negative pressure is always maintained substantially constant.

Figure 1G:
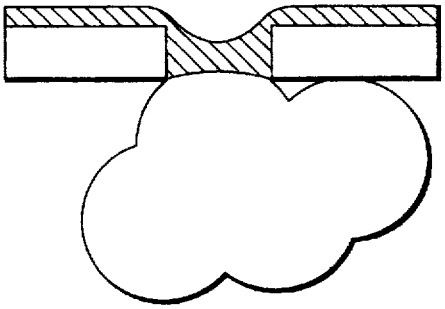

According to the consumption of the ink in the ink chamber, such air bubbles are generated repeatedly. The air bubbles sequentially generated, as shown in FIG. 1(G), are united with previously generated air bubbles and with the air bubbles that are generated from holes existing in the neighborhood into a larger air bubble, but the united air bubble is unstabilized and is ruptured in the end.

Figure 2:
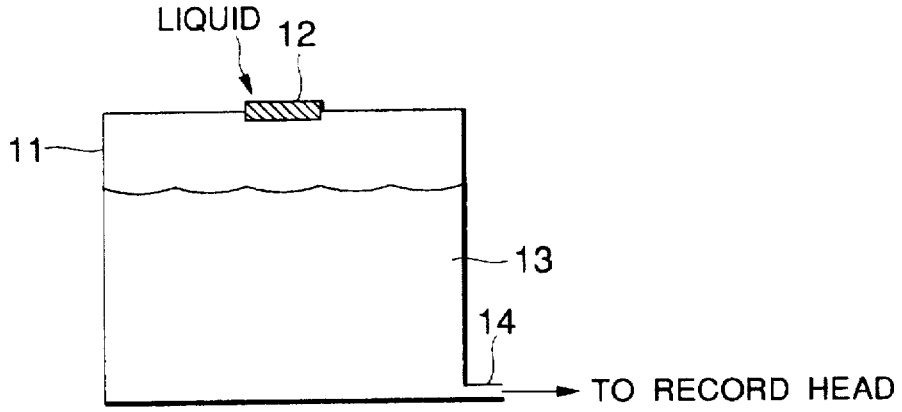
FIG. 2 is a basic structure view showing an ink supply device according to a first embodiment of the invention.

FIG. 2 is a basic structure view of a first embodiment of an ink supply device according to the invention. In FIG. 2, reference character 11 designates an ink chamber, 12 stands for a meniscus forming portion, 13 represents ink, and 14 points out an ink supply port. The ink 13 is stored in the ink chamber 11. The meniscus forming portion 12 is provided in part of the upper wall of the ink chamber 11. Also, in the ink chamber 11, there is formed the ink supply port 14 which is used to feed the ink 13 to a record head (not shown).

The meniscus forming portion 12, as shown in FIGS. 1(A) to 1(G), includes one or more minute holes. Liquid is supplied to the meniscus forming portion 12 by means of a liquid guide portion (not shown), and the meniscus of the liquid is formed in the minute hole(s). The liquid meniscus formed in the minute hole, as shown in FIGS. 1(A) to 1(G), is used to control the generation of air bubbles as well as to control the negative pressure in the ink chamber.

Figure 3A:
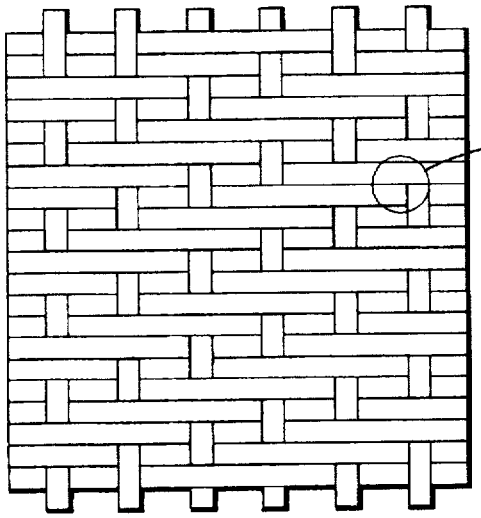
FIGS. 3(A) to 3(C) are explanatory views of a twilled gauze usable in a meniscus forming portion.
Figure 3C:
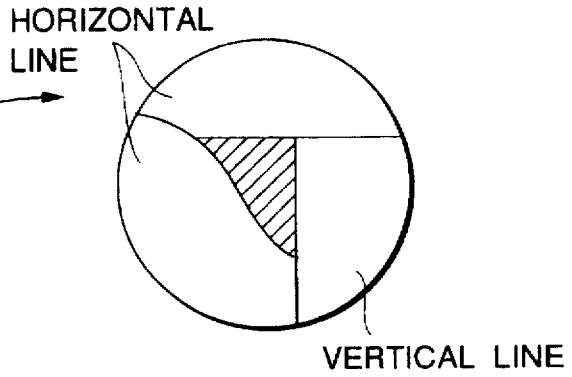
Figure 3B:
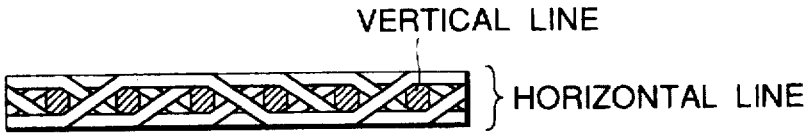

As the meniscus forming portion 12, there can be used a mesh-shaped member such as a gauze, a filter and the like, or a porous member such as a felt, a sponge and the like. Especially, a twilled Dutch weave gauze can be used favorably. Now, in FIGS. 3(A) to 3(C), there are shown explanatory views of a twilled Dutch weave gauze which can be used for the meniscus forming portion 12. When a gauze is used as the meniscus forming portion 12, the gauze can be woven in various methods. FIGS. 3(A) to 3(C) show a method in which a gauze having a twilled Dutch weave is woven. In the twilled Dutch weave, warps or vertical lines are respectively formed of heavy lines, while wefts or horizontal lines are in contact with one another and each of the wefts climbs over the warps each time. As shown in FIG. 3(A), when the twilled Dutch weave is viewed from the front surface thereof, it is not possible to see through the twilled Dutch weave because the wefts are in contact with one another. However, since the twilled Dutch weave has such a section structure as shown in FIG. 3(B), when the twilled Dutch weave is viewed obliquely, as shown in FIG. 3(C), there exists a triangular opening which is defined by a weft running obliquely from back to front or vice versa, a weft adjoining the obliquely running weft and extending straight, and a warp. The triangular opening provides a minute hole, in which air bubbles can be generated. In the gauze having a twilled Dutch weave, the meshes thereof can be woven finely, the meshes are even in sizes, and uniform air bubbles can be generated, so that a stable pressure control is possible. Also, because ink is allowed to move to the meshes quickly, the meniscus can be formed quickly to thereby eliminate the possibility that the negative pressure can be removed. Further, when compared with other gauzes having the same filtering performance, the twilled Dutch weave gauze is greater in mechanical strength and is thus stronger. Besides the twilled Dutch weave gauze, as the meniscus forming portion 12, a PET film, a PVC film or a PP film having both an ink resisting property and a strength can also be used favorably in such a manner that it includes a large number of minute holes each having a diameter of dozens of μm. Alternatively, PET minute balls of 100 μm or less can be hydrophilically treated and can be then sintered to produce a sintered member, that is, the sintered member can also be used favorably as the meniscus forming portion 12.

The diameter of the minute hole formed in the meniscus forming portion 12 is associated with the control of the negative pressure of the ink chamber, which can also be understood from the fact that it is used as a parameter in the above-mentioned equation (1). Therefore, the diameter of the hole may be set such that it corresponds to the negative pressure in the record head and also to the characteristics of the liquid to be supplied to the meniscus forming portion 12.

In FIG. 2, if ink is consumed in a record head (not shown) and ink stored in the ink chamber 11 is supplied from the ink supply port 14 to the record head, then the negative pressure in the ink chamber 11 is increased. As a result of this, as has been described with reference to FIGS. 1(A) to 1(G), air bubbles are produced from the minute holes in the meniscus forming portion 12 and thus such an amount of air as can cancel the increase of the negative pressure enters the ink chamber 11, which can always keep the interior of the ink chamber 11 almost in a constant negative pressure. For this reason, an almost constant pressure can be applied to the record head as well, thereby being able to execute stable recording.

Figure 4:
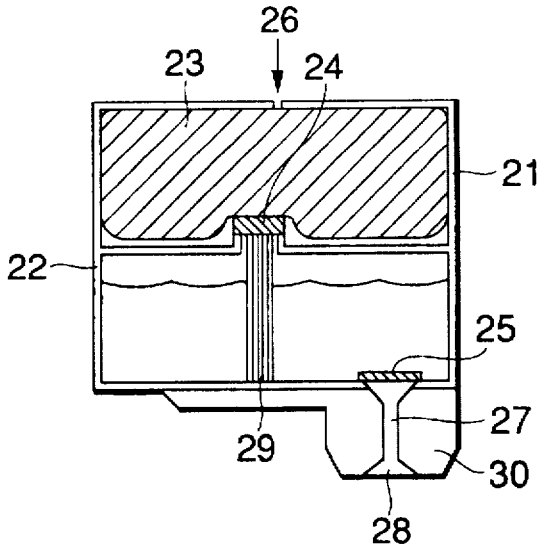
FIG. 4 is a structure view showing an ink supply device according to a second embodiment of the invention.

Referring now to FIG. 4, there is shown a structure view of a second embodiment of an ink supply device according to the invention. In FIG. 4, reference character 21 designates a sub-ink chamber, 22 a main ink chamber, 23 an ink absorbing member, 24 a meniscus forming portion, 25 a filter, 26 an air communication port, 27 a communication passage, 28 a record head, 29 an ink guide portion, and 30 a heat sink. In the second embodiment, the sub-ink chamber 21 is disposed on the structure shown in FIG. 2. Also, as liquid for sliding the meniscus forming portion 24, ink stored in the main ink chamber 22 is used. The ink supply device is formed in a box structure which is rigid and is formed of an ink resisting material in order to be able to hold the ink for a long period of time.

Within the sub-ink chamber 21, there is disposed the ink absorbing member 23. As the material of the ink absorbing member 23, there are available a fiber-like material having a two dimensional structure, a porous material having a three dimensional structure, a felt produced by spinning the fiber-like material into a three dimensional structure, a nonwoven fabric or the like. In particular, for example, there can be used a material stuffed with cotton produced by binding up polyester fibers in one direction, a polyester felt produced by spinning the polyester fibers into a three dimensional structure, a porous member such as polyurethane, melamine foam or the like. Of course, other materials can also be used, provided that they can provide a suitable capillary action with respect to ink and can provide a tolerance to ink.

Also, in the sub-ink chamber 21, there is formed an air communication port 26. The ink absorbing member 23 is allowed to communicate with the air through the air communication port 26 and is thus open to the atmospheric pressure. Since the ink in the ink absorbing member 23 is pushed by the atmospheric pressure or is drawn out toward the main ink chamber 22 from below the ink absorbing member 23 by means of the negative pressure, the ink in the absorbing member 23 can be used with high efficiency. In this case, the negative pressure within the main ink chamber 22 can be maintained in a constant level due to the capillary force of the ink absorbing member 23. In order to prevent the ink from flying out from the air communication port 26, it is possible to provide the air communication port 26 with a sheet which prevents the ink from passing therethrough but allows the air to transmit therethrough. Alternatively, the air communication port 26 may be formed by arranging a large number of minute holes which prevent the ink from flowing out therefrom. The peripheral portion of the ink absorbing member 23 is inserted into the sub-ink chamber 21 in such a manner that it is in close contact with the inner wall of the sub-ink chamber 21. The purpose of this is to prevent the air to be guided through the air communication port 26 from entering the sub-ink chamber 21 along the inner wall thereof.

The meniscus forming portion 24 is formed in a higher density than the ink absorbing member 23. The meniscus forming portion 24 is so disposed as to press against the ink absorbing member 23 provided in the sub-ink chamber 21 and is situated at a position slightly higher than the bottom surface of the sub-ink chamber 21. Thanks to this, even if the air can reach the bottom surface of the sub-ink chamber 21 through the side surfaces of the ink absorbing member 23, there is eliminated the possibility that the surface of the meniscus forming portion 24 can be covered with such air. This makes it possible to supply the ink held by the ink absorbing member 23 to the main ink chamber 22 through the meniscus forming portion 24 with high efficiency. The meniscus forming portion 24 itself is formed in the same manner as described before with reference to FIGS. 1(A) to 1(G) and 2. As the meniscus forming portion 24, for example, there can be used a stainless steel net of a twilled Dutch weave having a filtering precision of 60 μm.

The meniscus forming portion 24 includes an ink guide portion 29 on the surface thereof at the main ink chamber 22 side. The other end of the ink guide portion 29 is arranged so as to extend into the ink in the main ink chamber 22. Preferably, it may extend down to the bottom surface of the main ink chamber 22. The ink guide portion 29 may be formed of the material that can absorb the ink up to the meniscus forming portion 24 by means of its capillary force, for example, there can be used a cotton wadded member formed by bundling together polyester fibers in one direction. The ink guide portion 29 can take any arbitrary shape, for example, it may be formed in a slit-like shape, in a prism shape such as a triangular prism shape, in a cylindrical shape, or in an elliptically cylindrical shape. Also, the dimension of the section of the ink guide portion 29 should be smaller that the dimension of the opening of the meniscus forming portion 24. This makes it possible to provide a clearance in the periphery of the ink guide portion 29, thereby securing in the meniscus forming portion 24 a section in which air bubbles can be produced.

In FIG. 4, there is shown an ink supply device which is formed integrally with a record head. The record head 28 and the main ink chamber 22 are connected with each other by means of the communication passage 27 which is so disposed as to adjoin the heat sink 30. The filter 25 is provided at the entrance of the communication passage 27 of the main ink chamber 22. Also, the filter 25 is structured such that it has a filtering precision higher than that of the minute holes formed in the meniscus forming portion 24. For example, a filter having a filtering precision of 20 μm can be used. The filtering precision is decided based on the idea that the filter must trap foreign matters larger in size than the diameter of the ink flow passage in the record head 28. The filter 25 is used to filtrate dust and foreign matters in the ink within the main ink chamber 22, the cohered molecules of the ink, air bubbles and the like. At the same time, when the ink tank is removed from the printer and held in a lateral position and the ink is not in direct contact with both the filter 25 and meniscus forming portion 24, such filtration by the filter 25 eliminates the possibility that a pressure can be applied to the record head 28 through the filter 25.

In the record head 28, there are provided a large number of nozzles (not shown) at a high density. For example, 128 pcs. of nozzles are provided at a high density of 300 spi. Each of the nozzles includes a heating element (not shown) which generates air bubbles when it is electrically energized and jets ink droplets. In FIG. 4, the ink droplets are jetted downwardly.

Now, description will be given below of the operation of the second embodiment of an ink supply device shown in FIG. 4. While the ink supply device is not in use, as the ink is consumed, air collects in the upper portion of the sub-ink chamber and a capillary force is applied to the filter 24. Before the meniscus formed in the filter 24 is ruptured with consumption of the ink, the ink travels from the main ink chamber to the sub-ink chamber through the ink guide portion 29. Since the filter 25 is embedded in the ink, no capillary force is applied thereto. Also, the ink filled in such an amount that can be absorbed by the main ink chamber 22 and the ink absorbing member 23 of the sub-ink chamber 21. In this state, the record head 28 is kept in a negative pressure condition due to the capillary force of the ink absorbing member 23.

If recording is started and the ink is consumed in the record head 28, then a negative pressure is generated as the ink is consumed, which causes the ink contained in the ink absorbing member 23 to move to the main ink chamber 22 through the meniscus forming portion 24. In this case, the negative pressure is controlled by the capillary force of the ink absorbing force 23. However, since both sides of the meniscus forming portion 24 are filled with the ink, there can never be produced such air bubbles as shown in FIG. 1(A) to 1(G).

If the ink is consumed further and the ink contained in the ink absorbing member 23 is used up, then the surface of the meniscus forming portion 24 at the sub-ink chamber 21 is opened to the air. If the ink is consumed still further, then such production of air bubbles as shown in FIG. 1 occurs. In the beginning, the surface of the meniscus forming portion 24 at the main ink chamber 22 side is in contact with the ink and thus air bubbles appear in the ink of the main ink chamber 22. However, the air bubbles become larger gradually and form an air layer. In this state, the surface of the meniscus forming portion 24 at the main ink chamber 22 side is in contact with the air in the main ink chamber 22. In this state, if the meniscus forming portion 24 dries and the ink film disappears from the minute holes, then the pressure of the main ink chamber 22 provides the atmospheric pressure, so that the ink is caused to leak from the record head 28. However, the ink within the main ink chamber 22 is absorbed up by the capillary force of the ink guide portion 29 and is then supplied to the meniscus forming portion 24. In the meniscus forming portion 24, the ink absorbed up by the ink guide portion 29 is used to form a film in the minute holes by means of the interfacial tension of the meniscus forming portion 24. And, due to the meniscus of the ink, air bubbles are produced in such a manner as described with reference to FIG. 1, so that the pressure within the main ink chamber 22 can be kept almost in a constant level.

This operation continues until the ink guide portion 29 is detached from the ink. When the ink guide portion 29 extends down to the bottom surface of the main ink chamber 22, the negative pressure control operation will continue until the ink is substantially used up.

Now, description will be given of an operation to be performed when the environments are changed. At first, when the main ink chamber 22 is filled to the brim with ink and ink exists in the sub-ink chamber 21, the change in the environments has little effect on the operation. That is, since the same atmospheric pressure is applied to the ink absorbing member 23 in the sub-ink chamber 21 and the record head 28, even if the environments are changed, no differential pressure is generated.

Next, description will be given of an operation to be performed when no ink exists within the sub-ink chamber 21. In this case, for the most part, an air layer exists in the main ink chamber 22. If the temperature rises or the atmospheric pressure decreases, then the air within the main ink chamber 22 expands relatively. As a result of this, a balanced condition is lost in the meniscus forming portion 24 and, therefore, the ink is absorbed up through the ink guide portion 29 due to the interfacial tension of the meniscus with respect to the ink absorbing member 23 and is then absorbed by the ink absorbing member 23. Since the volume of the main ink chamber 22 decreases by an amount corresponding to the amount of the ink absorbed by the ink absorbing member 23, it is possible to prevent an increase in the pressure due to the expansion of the air. After then, if the air within the main ink chamber contracts or if the ink is consumed, then the ink absorbed into the ink absorbing member 23 is moved to the main ink chamber 22, so that the pressure in the main ink chamber 22 can be controlled.

Also, if the temperature falls or the atmospheric pressure rises and the air in the main ink chamber 22 contracts relatively, then the pressure in the main ink chamber 22 is adjusted by an operation similar to that as in the above-mentioned ink consumption case.

As described above, the ink supply device as shown in FIG. 4 can adapt itself to the change in its environments and, therefore, it is able to supply the ink to the record head with an almost constant pressure.

Figure 5:
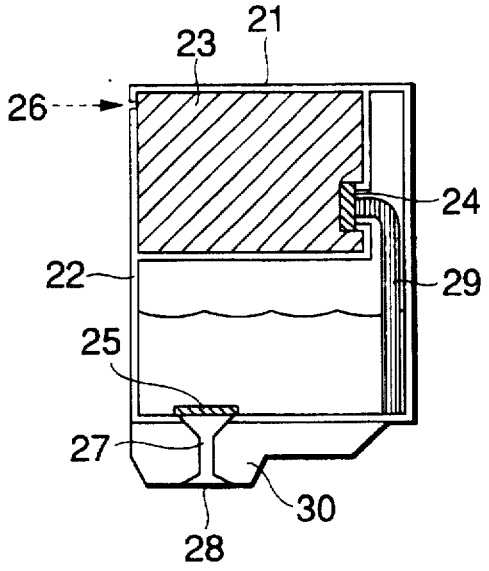
FIG. 5 is a structure view showing a modified version of an ink supply device according to the second embodiment of the invention.

Now, FIG. 5 is a structure view of a modification of the second embodiment of an ink supply device according to the invention. Reference characters used in FIG. 5 are similar to those used in FIG. 4. In the modification, the sub-ink chamber 21 is disposed in part of the upper portion of the main ink chamber, the air communication port 26 is formed in the side wall of the sub-ink chamber 21. Further, the meniscus forming portion 24 is provided in the side wall of the sub-ink chamber 21 in such a manner that it is connected with the main ink chamber 22. The ink guide portion 29 is formed in an inverted L shape such that one end thereof is connected with the surface of the meniscus forming portion 24 and the other end thereof extends into the ink.

The modified version of the second embodiment shown in FIG. 5 can be operated similarly to the second embodiment shown in FIG. 4. That is, when no ink is present in the sub-ink chamber 21, the ink absorbed up by the ink guide portion 29 is supplied to the meniscus forming portion 24 and the negative pressure within the main ink chamber 22 can be maintained substantially in a constant level due to a meniscus which is formed in the minute holes of the meniscus forming portion 24.

Figure 6A:
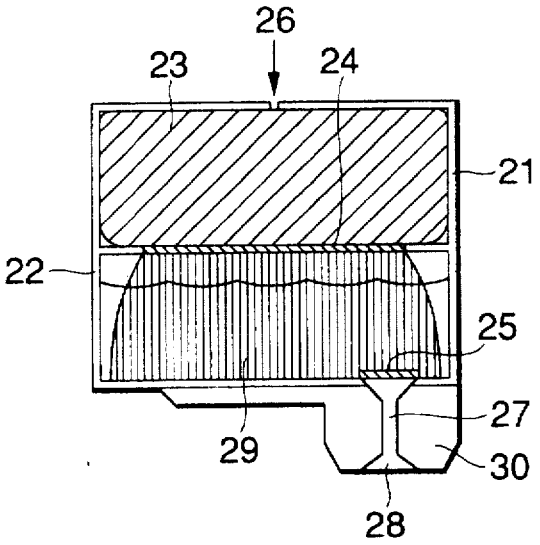
FIGS. 6(A) to 6(C) are structural views showing another modified version of an ink supply device according to the second embodiment of the invention.
Figure 6B:
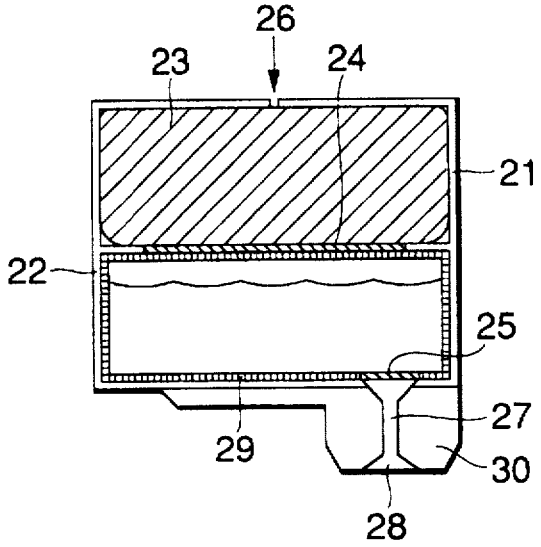
Figure 6C:
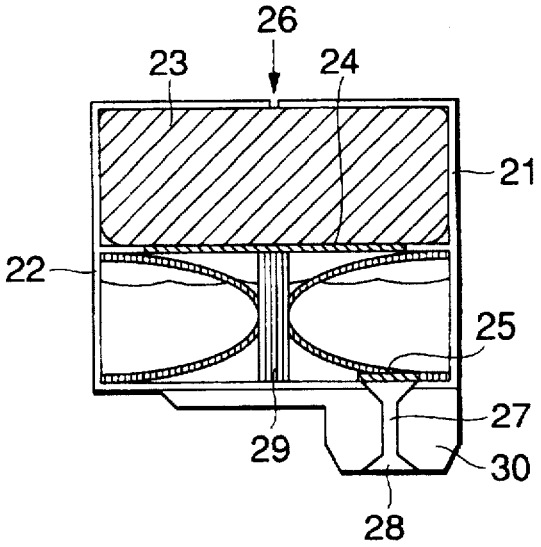

FIGS. 6(A) to 6(C) are structural views of another modification of the second embodiment of an ink supply device according to the invention. In FIGS. 6(A) to 6(C), reference characters are used similarly to those used in FIG. 4. Although the ink guide portion 29 is formed of a cylindrical member in the above-mentioned respective embodiments and modifications, this is not limitative but the ink guide portion 29 can be formed in other various shapes. In FIG. 6, the meniscus forming portion 24 is disposed on the same surface as the bottom surface of the sub-ink chamber 21.

The ink guide portion 29 shown in FIG. 6(A) is formed of a member which floats in the ink within the main ink chamber 22. With use of this structure, even if the ink supply device is removed from a printer and held in any attitude, the ink guide portion 29 moves together with the ink and is always in contact with the ink. Due to this, the ink is always supplied to the meniscus forming portion 24 by the ink guide portion 29 to thereby be able to maintain the meniscus formed in the meniscus forming portion 24 in a good condition.

Also, in FIG. 6(B), there is shown a structure in which the ink guide portion 29 is disposed such that it envelopes the inner surface of the main ink chamber 22. According to this structure, even if the ink supply device is removed from a printer and is held in any attitude, the ink guide portion 29 is always in contact with the ink. For this reason, the ink is always supplied to the meniscus forming portion 24 and thus the meniscus formed in the meniscus forming portion 24 can be maintained in a good condition.

Further, in FIG. 6(C), there is shown a structure in which the ink guide portion 29 branches off into a plurality of members or a plurality of sub-sections so as to extend to the respective corners of the main ink chamber 22. Thanks to this, even if the ink supply device is removed from a printer and is held in any attitude, part of the ink guide portion 29 is always in contact with the ink. This ensures that the ink can be always supplied to the meniscus forming portion 24 and the meniscus formed in the meniscus forming portion 24 can be kept in a good condition.

In this manner, according to the respective structures shown in FIGS. 6(A) to 6(C), the ink can be always supplied to the meniscus forming portion 24 and thus there is eliminated the possibility that the meniscus can be ruptured and the pressure of the interior of the main ink chamber 22 can be opened to the air. Also, the present structures can adapt themselves to the changes in the environments such as a rise in the open air temperature, a reduction in the atmospheric pressure, a fall in the open air temperature, an increase in the atmospheric pressure or the like, thereby being able to keep an almost constant negative pressure.

In the above-mentioned respective embodiments and modifications, a single meniscus forming portion and a single liquid guide portion are provided. However, this is not limitative but, alternatively, a plurality of ink guide portions can be connected to the different sections of the meniscus forming portion. This structure allows the ink to be supplied uniformly to the meniscus forming portion. Or, two or more sets of meniscus forming portions and liquid guide portions can be arranged. In this structure, for example, even if an air layer is formed between the ink absorbing member 23 and one of the meniscus forming portions and the ink contained in the ink absorbing member 23 does not travel to the main ink chamber 22, the ink can be moved by means of other meniscus forming portion(s), which prevents the ink from being left in the sub-ink chamber 21 so that the ink can be used efficiently.

Figure 7:
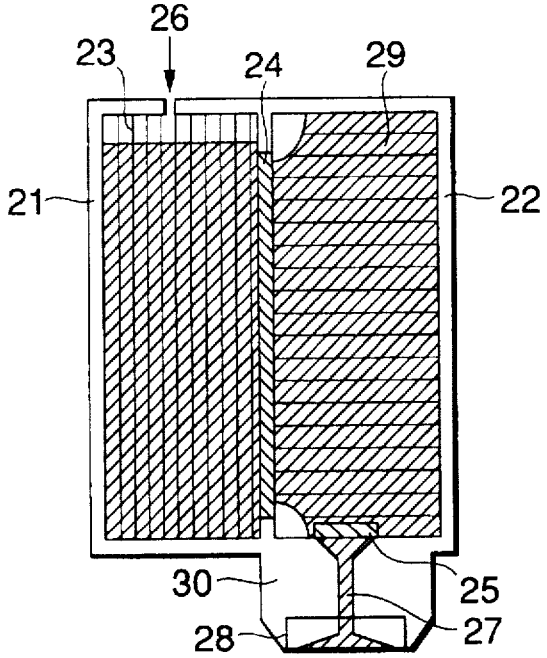
FIG. 7 is a structure view showing an ink supply device according to a third embodiment of the invention.

Referring now to FIG. 7, there is shown a structure view of a third embodiment of an ink supply device according to the invention. In FIG. 7, the same parts as those shown in FIG. 4 are given the same designations and the description thereof is omitted here. In FIG. 7, reference character 21 designates a sub-ink chamber, 22 a main ink chamber, 23 an ink absorbing member, 24 a meniscus forming portion, 25 a filter, 26 an air communication port, 27 a communication passage, 28 a record head, 29 an ink guide portion, and 30 a heat sink. In the third embodiment, the sub-ink chamber 21 and main ink chamber 22 are disposed horizontally in parallel to each other, and the meniscus forming portion 24 is interposed between the sub-ink chamber 21 and main ink chamber 22.

The ink absorbing member 23 is inserted into the sub-ink chamber 21 in such a manner that it is in contact with the meniscus forming portion 24 provided on the side wall of the sub-ink chamber 21. As the ink absorbing member 23, for example, there can be used a polyester felt having a density of 800 g/m$^2$.

The meniscus forming portion 24, in a portion where the ink exists in both the sub-ink chamber 21 and main ink chamber 22, permits the ink existing in one of them to be in communication with the ink existing in the other; in a portion where the ink exists only in one of them, the meniscus forming portion 24 adjusts the negative pressure by means of the surface tension of the ink; and in a portion where ink is present in neither of them, the meniscus forming portion 24 forms a meniscus and adjusts the negative pressure according to the process described in connection with FIGS. 1(A) to 1(G). The meniscus forming portion 24 is formed in such a manner that the density thereof is higher than that of the ink absorbing member 23.

The ink guide portion 29 is disposed within the main ink chamber 22 such that it is in contact with the meniscus forming portion 24. In the third embodiment, the ink guide portion 29 is formed of polyurethane foam. As the material of the ink guide portion 29, there can be used various materials such as a one-dimension structure of a polyester fiber, two-dimension and three-dimension fiber structures of a porous material including melamine foam, and the like, provided that they have a proper capillary force with respect to the ink, do pollute the ink and are resistant to the ink. As shown in FIG. 7, the ink guide portion 29 can be structured such that it can be disposed over the whole main ink chamber 22. Of course, the ink guide portion 29 can be structured as in the above-mentioned respective embodiments and modifications, or, on the contrary, the ink guide portion 29 having the structure shown in the third embodiment can also be used in the above embodiments and modifications.

The ink guide portion 29 need not be in contact with all of the opening of the meniscus forming portion 24. For example, the ink guide portion 29 can be structured in such a manner that is can be in contact with a portion of 50% of the opening area of the meniscus forming portion 24. In this case, the ink is supplied to the portion of the opening not in contact with the guide portion 29 due to the capillary force of the meniscus forming portion 24 itself to thereby produce a meniscus there. When air bubbles are generated from the meniscus forming portion 24, the air bubbles pass through the portion of the opening not in contact with the ink guide portion 29 to the main ink chamber 22. Due to this, when compared with a case in which the air bubbles pass through the interior of the ink guide portion 29 to the main ink chamber 22, a pressure loss can be reduced to one tenths and thus stable printing can be achieved even in the solid typesetting printing that is involved with a large pressure loss.

The ink guide portion 29 is not necessary when the ink supply device is used in a normal condition. However, as will be described later, when the ink supply device is removed from a printer and, for example, it is left in such an attitude that the meniscus forming portion 24 is situated in the upper portion of the main ink chamber, if worst comes to worst, the both surfaces of the meniscus forming portion 24 are exposed to the air to dry, so that the meniscus can be destroyed. Even in such case, by providing the ink guide portion 29, the ink that is absorbed up by the ink guide portion 29 is supplied to the meniscus forming portion 24, so that the meniscus can be always formed in the meniscus forming portion 24. Also, in such state, when the pressure in the ink tanks is relatively increased as the open air temperature rises or as the atmospheric pressure decreases, the ink in the main ink chamber 22 is absorbed up by the ink guide portion 29 to travel through the meniscus forming portion 24 into the ink absorbing member 23, so that the negative pressure in the ink tank can be maintained in a proper range. In this manner, no matter what attitude the ink supply device may be placed in, there is no possibility that the meniscus can be destroyed and also that the negative pressure within the ink supply device can be removed. Also, the ink guide portion 29 further has a function to supply the ink to the meniscus forming portion 24 uniformly.

Figure 8:
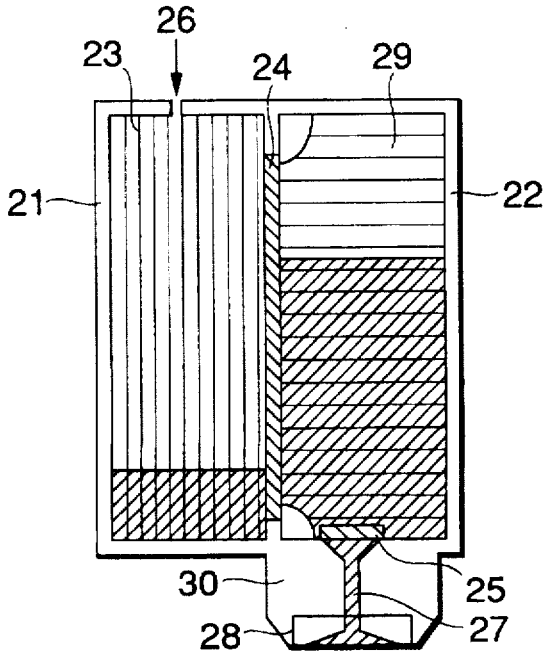
FIG. 8 is a section view showing an ink supply device according to the third embodiment of the invention, showing a state thereof in which ink has been consumed to a certain degree.

Next, description will be given below of the operation of the third embodiment of an ink supply device according to the invention shown in FIG. 7. Here, FIG. 8 is a section view of the third embodiment of an ink supply device according to the invention, showing when the ink is consumed to a certain degree. In FIG. 8, reference characters are similar to those used in FIG. 7. At first, in the shipment from the factory, as shown in FIG. 7, the ink supply device is filled with ink in such a manner that the sub-ink chamber 21 is filled with ink to a degree corresponding to 80% of the internal cubic volume thereof and the main ink chamber 22 is filled with ink to a degree corresponding to 100% of the internal cubic volume thereof. In this state, the ink pressure in the record head 28 is, for example, −20 mm$H_2O$ and this is maintained by the capillary force of the ink absorbing member 23. After then, airtight seals respectively are stuck to the nozzle portion of the record head 28 and the air communication port 26, before they are packaged.

When recording is started and the ink is consumed in the record head 28, then a negative pressure generated during this operation causes the ink contained in the ink absorbing member 23 to travel through the meniscus forming portion 24 to the main ink chamber 22, and the air moves gradually from the air communication port 26 into the sub-ink chamber 21 and spreads. The negative pressure during this is controlled by the capillary force of the ink absorbing member 23. In the beginning, the ink is present on the two sides of the meniscus forming portion 24 and, therefore, the minute holes of the meniscus forming portion 24 are used for the movement of the ink and thus such generation of the air bubbles as shown in FIGS. 1(A) to 1(G) can never occur.

If the ink in the sub-ink chamber 21 is consumed to a certain degree, then the portion of the meniscus forming portion 24 on the sub-ink chamber 21 side thereof is gradually exposed to the air starting at the upper portion thereof and an ink surface is formed in the meniscus forming portion 24. In this state, the pressure is controlled in accordance with a relationship between the ink holding force of the ink absorbing member 23 and the ink surface tension of the meniscus forming portion 24. In this case, the density of the ink absorbing member 23 is set lower than the density of the meniscus forming portion 24. Due to this, the holding force of the ink absorbing member 23 is smaller than the surface tension of the ink surface of the meniscus forming portion 24 and thus the ink can be moved from the sub-ink chamber 21 to the main ink chamber 22 due to the increase in the negative pressure within the main ink chamber 22, which eliminates the possibility that the air can break the ink surface to enter the main ink chamber 22. If the densities of the ink absorbing member 23 and meniscus forming portion 24 are set otherwise, then the ink can be moved from the sub-ink chamber 21 to the main ink chamber 22 only to a degree corresponding to a difference between the heights of the ink, due to a pressure head.

If the ink is consumed still further and the ink contained in the ink absorbing member 23 is used up or a difference between the heights of the ink in the sub-ink chamber 21 and main ink chamber 22 reaches its limit, then the air bubbles push against the ink surface of the meniscus forming portion 24 and enter the main ink chamber 22. The negative pressure within the main ink chamber 22 is relieved by the amount of the air that has entered the main ink chamber 22. The air bubbles that have entered the main ink chamber 22 collect on the upper portion of the main ink chamber 22 and form an air layer, whereby the surface of the ink within the main ink chamber is caused to lower gradually. If there is left any ink in the sub-ink chamber 21, then the ink remaining in the sub-ink chamber 21 is moved to and consumed in the main ink chamber 22 in an amount corresponding to the lowered ink surface of the main ink chamber 22.

If the ink is consumed yet further, then the upper portion of the meniscus forming portion 24 becomes open to the air on the two side surfaces thereof. That is, the surface of the meniscus forming portion 24 at the sub-ink chamber 21 side thereof is open to the air, while the surface of the meniscus forming portion 24 at the main ink chamber 22 side thereof is exposed to the layer of the air that has entered the main ink chamber 22. This state is shown in FIG. 8. In the portion of the meniscus forming portion 24 with both surfaces thereof opened to the air, an ink meniscus is formed in the minute holes of the meniscus forming portion 24. With an increase in the negative pressure within the main ink chamber 22, the air bubbles are caused to enter the main ink chamber 22 due to the operation described with reference to FIG. 1. Also, although this portion is not in direct contact with the ink, the lower portion of the meniscus forming portion 24 is in contact with the ink and, therefore, the ink is absorbed up to the upper portion of the meniscus forming portion 24 due to the capillary force of the meniscus forming portion 24. Further, the ink is also absorbed up by the ink guide portion 29 and is then supplied to the meniscus forming portion 24. This eliminates the possibility that the ink meniscus formed in the meniscus forming portion 24 can disappear. In this state, as elements to cancel the increase in the negative pressure within the meniscus forming portion, there are available three elements: that is, a first element is the movement of the ink in the sub-ink chamber 21 to the main ink chamber 22, a second element is the entrance of the air bubbles into the main ink chamber 22 from the ink surface formed in the middle portion of the meniscus forming portion 24, and a third element is the entrance of the air bubbles into main ink chamber 22 from the ink meniscus formed in the meniscus forming portion 24. Among the three elements, the movement of the ink and the entrance of the air bubbles from the meniscus are executed in a well-balanced manner to thereby be able to maintain the negative pressure within the main ink chamber 22 in an almost constant level. This operation continues until the ink within the main ink chamber 22 is used up completely, so that the ink supply pressure to the record head 28 can be kept constant until the ink within the ink supply device is consumed completely. This can realize a highly efficient ink supply device. Also, since the variations in the ink pressure in the record head 28 is restricted to a minimum, the ink jetting property can be stabilized as well as the image quality can be improved.

Now, description will be given below of the operation to be performed when the peripheral environment varies. Firstly, when the main ink chamber 22 is filled to the brim with ink and any ink exists in the sub-ink chamber 21, the ink supply device will not be influenced so much by the change in the peripheral environment. Since the same atmospheric pressure is applied to the ink absorbing member 23 in the sub-ink chamber 21 and the record head 28, there cannot be generated any pressure difference between them even if the peripheral environment changes.

Next, description will be given below of the operation to be performed when an air layer exists in the main ink chamber 22. If the temperature rises or the atmospheric pressure decreases, then the air within the main ink chamber 22 expands relatively. Such expansion of the air causes the meniscus forming portion 24 to lose its balanced condition, so that the ink in the main ink chamber 22 is moved to the sub-ink chamber 21 and is then absorbed by the ink absorbing member 23. Since the volume of the interior of the main ink chamber 22 decreases by the amount of the ink absorbed by the ink absorbing member 23, an increase in the pressure due to the expansion of the air can be prevented. After then, if the air in the main ink chamber 22 contracts, then the negative pressure will be controlled similarly to the above-mentioned case in which the ink is consumed. Also, in a case in which the temperature falls or the atmospheric pressure increases to thereby contract the air in the main ink chamber 22 relatively, the pressure in the main ink chamber 22 will be adjusted according to a similar operation to the above-mentioned ink consumed case.

As described above, the ink supply device as shown in FIG. 7 also can adapt itself to the change in the environment and this can always supply the ink to the record head with an almost constant pressure.

Figure 9A:
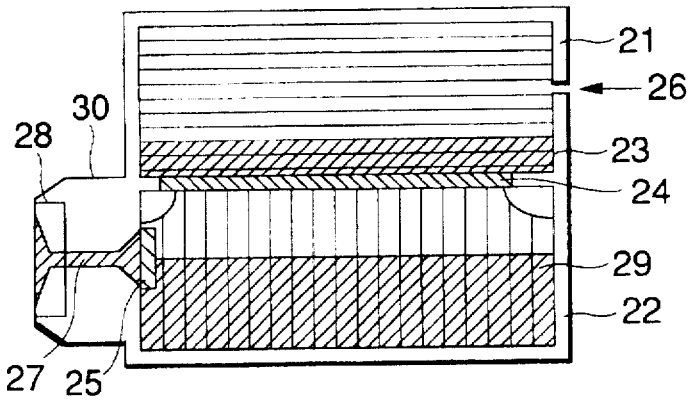
FIGS. 9(A) to 9(C) are explanatory views showing the operations of an ink supply device in the various attitudes thereof according to the third embodiment of the invention.
Figure 9B:
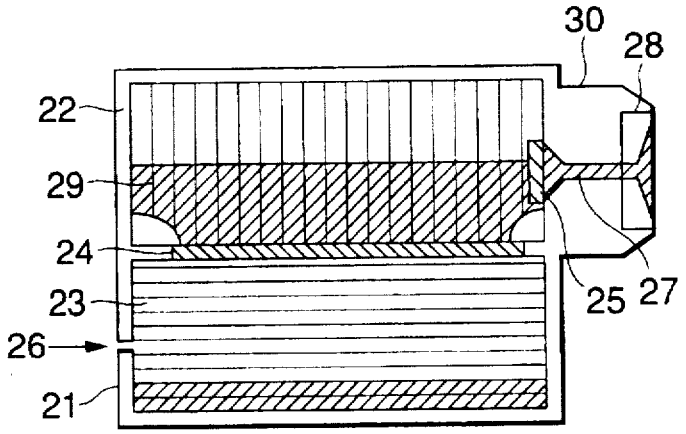
Figure 9C:
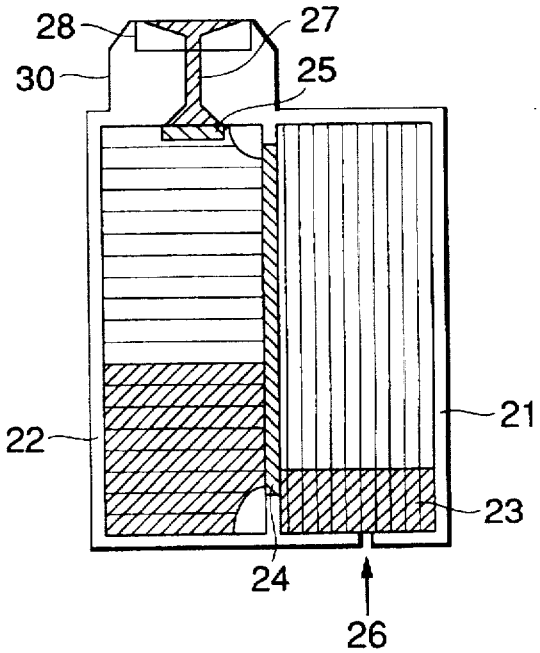

Now, FIGS. 9(A) to 9(C) are explanatory views of the third embodiment of an ink supply device according to the invention, showing the operations of thereof to be performed in various attitudes of the present ink supply device. Let us assume a case, for example, in which the ink supply device is removed from a printer and is left alone in various attitudes. FIG. 9 illustrates various examples in which, when printing has been executed to a certain degree and, for example, the amount of the remaining ink reaches about 40% or so, the ink supply device is left alone in the respective attitudes.

For example, as shown in FIG. 9(A), it is assumed that the ink supply device is left alone in such a manner that the main ink chamber 22 is located down and the sub-ink chamber 21 is located up. In this case, if the ink remains in the sub-ink chamber 21, then the meniscus forming portion 24 is held such that it is wet with the ink. However, the ink does not always remain in the sub-ink chamber 21 and, in the worst case, the two surfaces of the meniscus forming portion 24 can be wholly exposed to the air. Actually, however, the ink is supplied to the meniscus forming portion 24 by the ink guide portion 29, whereby the meniscus can never be so dry to be destroyed but the negative pressure can be maintained to thereby prevent generation of inconveniences such as an outflow of the ink from the nozzle and the like. In normal use, that is, in such case as shown in FIGS. 7 and 8, the above-mentioned operation is possible without provision of the ink guide portion 29. However, allowing for the attitude shown in FIG. 9(A), it is preferable to provide the ink guide portion 29.

In this attitude, for example, if the temperature rises or the atmospheric pressure decreases, then the air within the main ink chamber 22 contracts relatively. As a result of this, by means of a similar operation to the second embodiment shown in FIG. 4, the ink within the main ink chamber 22 travels to the sub-ink chamber 21, so that the negative pressure in the main ink chamber 22 can be maintained. If the temperature falls or the atmospheric pressure increases, then the air within the main ink chamber 22 contracts relatively, and the ink within the sub-ink chamber 21 moves to the main ink chamber 22 or the air bubbles pass through the meniscus forming portion 24 into the main ink chamber 22, thereby being able to keep the negative pressure within the main ink chamber 22.

As shown in FIG. 9(B), the ink supply device is assumed to be left alone such that the sub-ink chamber 21 is located up and the main ink chamber 22 is located down. In this case, since the ink in the main ink chamber 22 collects on the surface of the meniscus forming portion 24, the meniscus forming portion 24 is always kept wet to thereby prevent the ink meniscus from breaking away. If the environment varies, for example, if the temperature rises or the atmospheric pressure decreases and thus the air within the main ink chamber 22 expands relatively, then the ink in the main ink chamber 22 moves through the meniscus forming portion 24 to the sub-ink chamber 21, thereby being able to keep the negative pressure of the interior of the main ink chamber 22. On the other hand, if the temperature falls or the atmospheric pressure increases and thus the air in the main ink chamber 22 contracts relatively, then the air pushes against the ink surface of the meniscus forming portion 24 and then enters the main ink chamber 22 in the form of air bubbles to thereby increase the volume of the air in the main ink chamber 22, so that the negative pressure in the main ink chamber 22 can be maintained.

As shown in FIG. 9(C), the ink supply device is assumed to be left alone in such a manner that it is turned upside down. In this state, likewise in the normal state, the meniscus forming portion 24 is partly in contact with the ink and, therefore, the portion 24 is always kept wet. Also, in order to prevent the leakage of the ink, in the air communication port 26, for example, there is provided a sheet which prohibits the ink from passing therethrough but allows the air to pass therethrough. In this state, if the temperature rises or the atmospheric pressure decreases, then the airs respectively existing in the sub-ink chamber 21 and in the main ink chamber 22 expand relatively. That is, since the air communication port 26 is closed by the ink, the air in the sub-ink chamber 21 also expands. If an airtight seal is stuck on the nozzle surface of the record head 28, then the pressure of the air existing therein is caused to increase simply. In this case, a certain amount of ink can be moved according to the amount of the air existing in the sub-ink chamber 21 and the amount of the air in the main ink chamber 22. When the nozzle surface of the record head 29 is open to the air, the ink in the sub-ink chamber moves into the main ink chamber 22 to thereby cancel the change in the pressure within the sub-ink chamber 21. Further, the air in the main ink chamber 22 moves to the record head 28 to thereby cancel the amount of the air moved to the main ink chamber 22 and the amount of expansion of the air in the main ink chamber 22. During this, the ink pushed up by the air flows out from the nozzle surface of the record head 28 but, however, the amount of the ink collecting in the communication passage 27 and record head 28 is so small that is can be neglected. Even in this state, if the ink supply device is mounted to the printer again and a maintenance operation is performed thereon, then the ink supply device can be restored to a good condition. On the other hand, if the temperature falls or the atmospheric pressure increases and thus the air in the main ink chamber 22 contracts relatively, then the air pushes against the ink surface from the air communication port 26 and enters the sub-ink chamber as air bubbles, thereby being able to maintain the negative pressure of the main ink chamber.

As described above, not only when the ink supply device is left alone in a normal state that the surface of the record head 28 faces vertically downward but also even if the ink supply device is left alone in other various attitudes as shown in FIG. 9, part of the ink guide portion 29 is always in contact with the ink and thus, even when the environment changes, the ink is allowed to move between the main ink chamber 22 and sub-ink chamber 21, so that no special problem can be raised.

Figure 10:
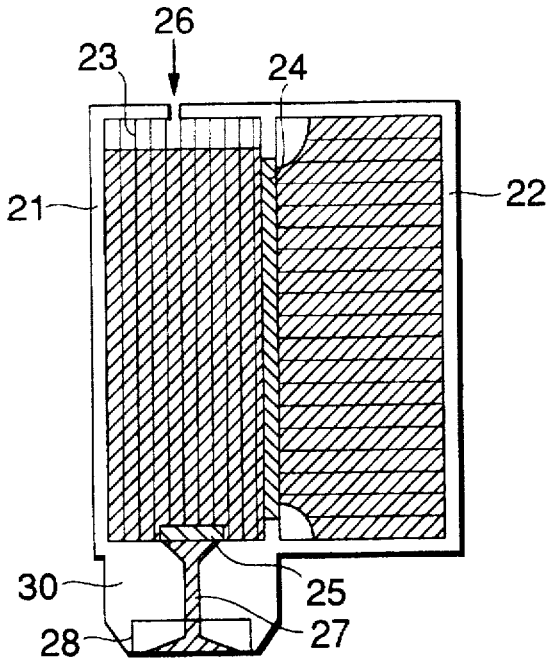
FIG. 10 is a structure view showing a modified version of an ink supply device according to the third embodiment of the invention.

Now, FIG. 10 is a structure view of a modification of the third embodiment of an ink supply device according to the invention. In FIG. 10, reference characters are used similarly to those in FIG. 7. In this modification, the communication passage to the record head 28 is disposed on the sub-ink chamber 21 side. In the present modification as well, the ink supply device can be operated substantially in the same manner as the above-mentioned third embodiment by controlling the filtering precision of the ink absorbing member 23 and meniscus forming portion 24. In addition to this, for example, even if the meniscus to be formed in the meniscus forming portion 24 is destroyed, the negative pressure can be maintained to a certain degree by the ink absorbing member 23. Due to this, the present modification has an advantage that the destruction of the meniscus does not have serious effects on the performance of the ink supply device.

Figure 11:
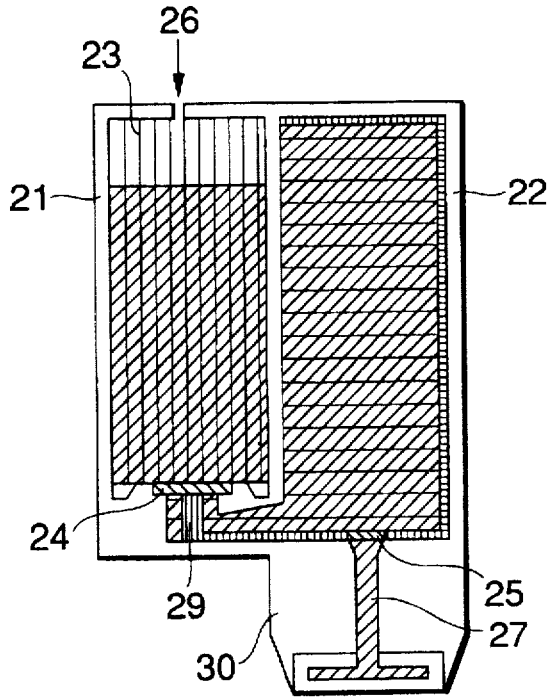
FIG. 11 is a structure view showing an ink supply device according to a fourth embodiment of the invention.
Figure 12:
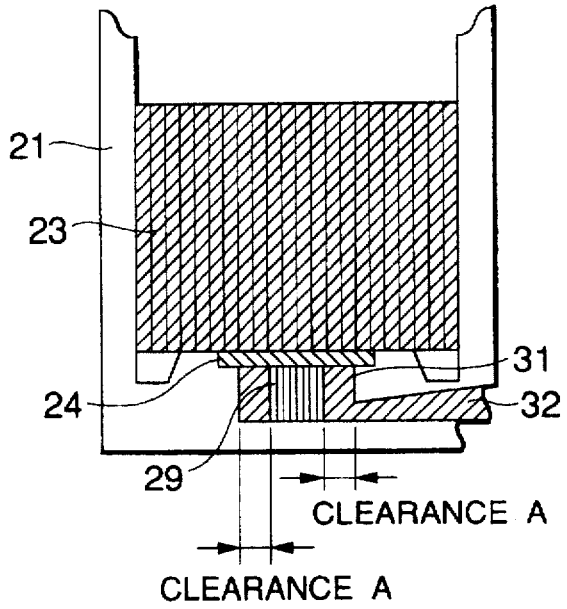
FIG. 12 is an enlarged view showing a sub-ink chamber used in an ink supply device according to the fourth embodiment of the invention.

FIG. 11 is a structure view of a fourth embodiment of an ink supply device according to the invention and FIG. 12 is an enlarged view of a lower portion of a sub-ink chamber employed in the fourth embodiment. In these figures, the same parts as those shown in FIG. 4 are given the same designations and the description thereof is omitted here. Reference character 31 designates a communication hole and 32 stands for a lower portion space. In the fourth embodiment, the main ink chamber 22 and sub-ink chamber 21 are disposed in such a manner that they adjoin each other. In the lower portion of the sub-ink chamber 21, there is formed a communication hole 31 and the sub-ink chamber 21 is connected in communication with the main ink chamber 22 through the lower portion space 31. The section of the communication hole 31 can take various shapes such as a circular shape, an elliptical shape, a polygonal shape, a star shape, a cross shape, a slit shape and the like. The upper wall of the lower portion space 32 may be formed flat. However, as shown in FIGS. 11 and 12, if it is arranged in such a manner that it becomes gradually higher toward the main ink chamber 22, then air bubbles to be generated in the communication hole 31 can be moved to the main ink chamber 22 smoothly.

The meniscus forming portion 24 is disposed in such a manner that it can cover the communication hole 31 and can come into contact with the bottom portion of the ink absorbing member 23. For example, the meniscus forming portion 24 can be disposed such that it projects by several millimeters from the bottom surface of the ink absorbing member 23. In this case, the meniscus forming portion 24 is pressed against the ink absorbing member 23 and the surface of the meniscus forming portion 24 is immersed in the ink absorbing member 23, thereby being able to provide a better fluid connection.

The ink guide portion 29 adjoins the meniscus forming portion 24 and extends downwardly through the communication hole 31. In the normal operation of the ink supply device, the ink guide portion 29 is allowed to perform its function if it extends down to the lower portion space 32, while it can be operated until the ink is used up if it extend further down to the bottom surface of the lower portion space 32. However, no matter what attitude the ink supply device may take, in order to supply the ink to the meniscus forming portion, it is desirable to extend the ink guide portion 29 through the lower portion space 32 further down to the respective surfaces or corners of the interior of the main ink chamber 22. The ink guide portion 29 can be disposed in various forms within the main ink chamber 22. For example, the ink guide portion 29 can be disposed in the form as shown in FIGS. 6(A) to 6(C), it can be arranged wholly as shown in FIG. 7, and so forth. Also, as shown in FIG. 12, the size of the section of the ink guide portion 29 is set smaller than the size of the opening of the meniscus forming portion 24 and there is formed a clearance A in the periphery of the ink guide portion 29. Thanks to this, the air bubbles can be generated in the meniscus forming portion 24 with the air not allowed to pass through the ink guide portion 29. Preferably, the clearance A may have a width of 0.5 mm or more. The ink guide portion 29 may be mounted directly to the meniscus forming portion 24 or may be fixed by ribs from the side wall of the communication hole 27.

Now, description will be given below of an example of the operation of the fourth embodiment of an ink supply device according to the invention. The state shown in FIG. 11 is an ink filled state. In this state, the ink supply device is filled with ink such that the ink absorbing member 23 is filled with ink about 80% of the internal cubic volume thereof and the main ink chamber 22 is filled 100% of the internal cubic volume thereof. The ink pressure in the record head 28 can be set as −20 $mmH_2O$, for example. The ink pressure is realized by the capillary force of the ink absorbing member 23 and thus the ink is held by such ink pressure. As a starting state for use, from the viewpoint of an ink use efficiency, it is preferable to fill the ink as much as possible. However, in order that a negative pressure can be generated by means of the capillary force of the ink absorbing member 23, an ink unfilled portion of a certain degree is necessary in the ink absorbing member 23. Before use, it is possible to stick airtight seals to the nozzle portion of the record head 29 and the air communication port 26. In this state, the ink supply device is packaged.

When printing is started, then the ink is consumed in the record head 28 and the ink is supplied from the main ink chamber 22 through the communication passage 27 to the record head 28 by the amount of ink consumed. As a result of this, while the ink absorbing member 23 is holding the ink, the ink within the ink absorbing member 23 is moved through the lower portion space 32 to the main ink chamber 22 and the air spreads gradually from the air communication port 26 into the ink absorbing member 23. This operation continues until the air reaches the meniscus forming portion 24. During this, even if the air bubbles and the like reach the meniscus forming portion 24, since the filtering precision of the meniscus forming portion 24 is finer than the ink absorbing member 23, the movement of the ink continues while the air bubbles are being trapped on the meniscus forming portion 24.

If the ink within the sub-ink chamber 21 is consumed almost completely and the air reaches the meniscus forming portion 24, then an interface between the ink and air is formed on the meniscus forming portion 24. If the ink is consumed further and the negative pressure gradually increases, then the air pushes against the interface between the ink and air formed on the meniscus forming portion 24 and enters there to thereby produce a fine air bubble in the portion of the meniscus forming portion 24 at the lower portion space 32 side thereof. The thus produced fine air bubble is united with another fine air bubble produced adjacently thereto, a following air bubble and the like to provide a large air bubble, thereby forming an air layer in the portion of the communication hole 31. In this state, the two sides of the meniscus forming portion 24 are exposed to the air and an ink meniscus is formed in the minute holes existing in the meniscus forming portion 24. During this operation, the ink is always supplied to the meniscus forming portion 24 by the ink guide portion 29.

If the ink is consumed still further, then the air turns into air bubbles by means of the process described in connection with FIG. 1 and then moves into the lower portion space 32 side of the meniscus forming portion 24. If air collects to a certain extent in the communication hole 31, then part of the air becomes air bubbles, which travel through the lower portion space 32 to the main ink chamber 22. In this operation, since the upper wall of the lower portion space 32 is so formed as to extend obliquely toward the main ink chamber 22, the air bubbles are allowed to move smoothly through the lower portion space 32 and arrive at the main ink chamber 22. The air bubble that have arrived at the main ink chamber 22 collect in the upper portion of the main ink chamber 22. In this manner, the pressure of supply of the ink to the record head 28 can be maintained in a constant level.

When circumstances are changed, the same operation as that in the above-mentioned second embodiment shown in FIG. 4 is performed. For that reason, even though the circumstances are changed, the negative pressure can be maintained, resulting in no problems. Also, even though the ink supply device is detached from the printer and is laid in any pose, ink can be always supplied to the meniscus forming portion 24 by extending the ink guide portion 29 to each portion within the main ink chamber 22, thereby keeping the negative pressure.

Referring to the positional relationship between the main ink tank 22 and sub-ink tank 21 in the fourth embodiment, as shown in FIG. 11, they can be arranged by dividing the ink tank into two sections, the main ink chamber can be so arranged as to enclose the two or three sides of the sub-ink chamber, or the sub-ink chamber can be disposed in the main ink chamber like an island. In these structures, if the side surfaces of the ink tank are wholly or in part formed of a transparent material, then the liquid surface in the main ink chamber can be confirmed from every directions. As the confirming method, there are available a visually confirming method, a photo sensor method and the like. Also, since they only have to be in communication with each other through the lower portion space 32, the main ink chamber 22 and sub-ink chamber 21 can be disposed spaced apart from each other.

In the above-mentioned respective embodiments, the record head 28 is connected by forming the communication passage 27 on the bottom surface of the main ink chamber 22 or sub-ink chamber 21. However, alternatively, the record head 28 can also be structured such that the communication passage 27 is connected with the lower portion of the side surface of the main ink chamber 22 or sub-ink chamber 21. Also, in the above-mentioned respective embodiments, there is shown the ink supply device that is formed integrally with the record head. However, this is not limitative but the ink supply device can also be structured separately from the record head. In this case, the ink supply port of the record head can be formed in the bottom portion or side surface lower portion of the main ink chamber. Or, like a siphon, there can be employed a structure in which the ink is absorbed from the bottom portion of the ink supply device up to the upper portion of the main ink chamber by means of a duct and the ink is then supplied to the record head.

Also, in the second to fourth embodiments, the ink absorbing member 23 and meniscus forming portion 24 are illustrated as separate members but, however, they can be formed integrally with each other. That is, a certain surface of the ink absorbing member 23 or a portion of such surface is worked in such a manner that it has a higher density than the remaining portions of the ink absorbing member 23. This working can be achieved by thermal treatment or the like. And, the ink absorbing member 23 may be fixed to the wall surface of the sub-ink chamber 21 in such a manner that it can be connected in communication with the main ink chamber 22 through the high density portion. Thus, the high density portion of the ink absorbing member 23 can operate as the meniscus forming portion 24 and can control the negative pressure of the main ink chamber quite well as described before.

Figure 13:
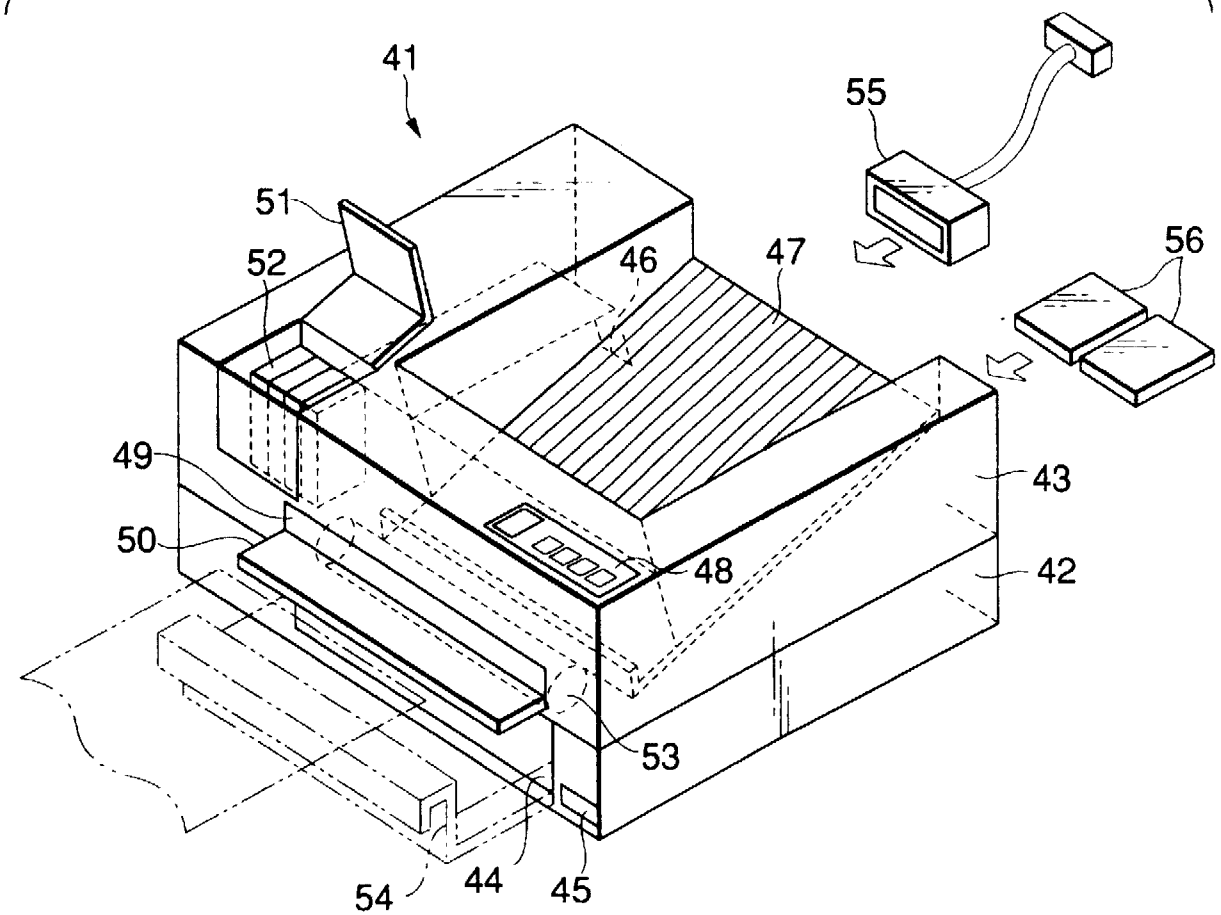
FIG. 13 is an appearance view showing an example of an ink jet printer.
Figure 14:
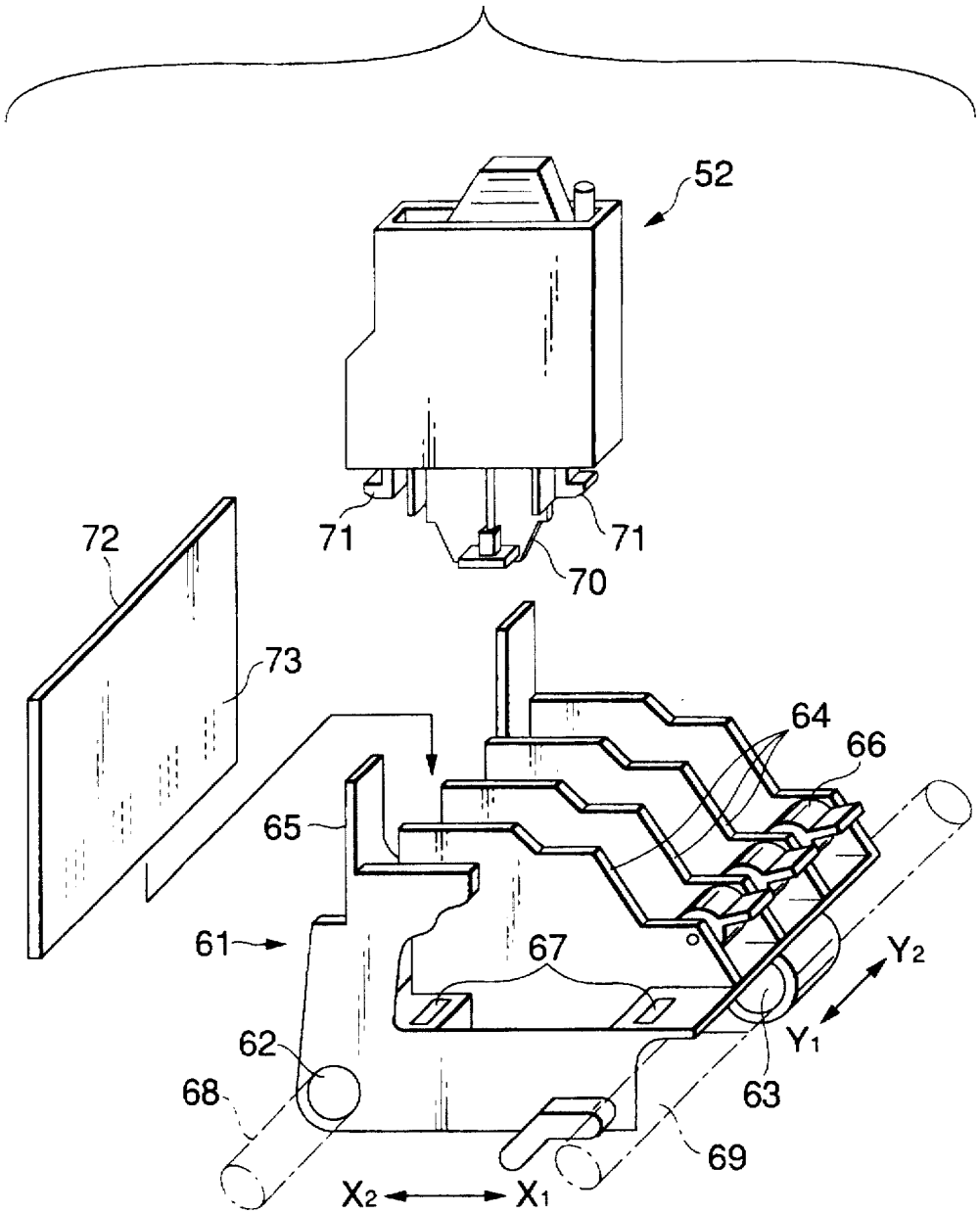
FIG. 14 is an enlarged view showing a mounting portion of an ink supply device.

Now, FIG. 13 is an appearance view of an embodiment of an ink jet printer, while FIG. 14 is an enlarged view of a mounting portion of the ink supply device. In FIGS. 13 and 14, reference character 41 designates an ink jet printer, 42 a lower case, 43 an upper case, 44 a tray insertion opening, 45 a dip switch, 46 a main switch, 47 a paper tray, 48 a panel console, 49 a hand insertion opening, 50 a hand insertion tray, 51 an ink cartridge insertion cover, 52 an ink cartridge, 53 a paper feed roller, 54 a paper tray, 55 an interface cable, 56 a memory card, 61 a carriage, 62 a screw shaft through hole, 63 a guide shaft through hole, 64 a partition wall, 65 a rear wall, 66 a lock mechanism, 67 an engaging groove, 68 a screw shaft, 69 a guide shaft, 70 a record head, 71 an engaging projection, 72 a connecting board, and 73 a connecting terminal, respectively.

The box member of the ink jet printer 41 is formed substantially of the lower case 42 and upper case 43, in which there are stored electric circuits (not shown), drive system parts (not shown) and the like. The lower case 42 includes the tray insertion opening 44 formed therein, from which opening 44 is inserted the paper tray 54 with one or more sheets of paper stored thereon, whereby the paper can be loaded into the ink jet printer 41.

Also, the dip switch 45 and main switch 46 are mounted on the lower case 42. The dip switch 45 is used to set part of the operation of the ink jet printer 41, that is, it is so arranged as to set functions of low frequency of setting change. When not in use, the dip switch 45 is covered with a cover. The main switch 46 is used to turn on or off the power source of the ink jet printer 41. The lower case 42 further includes an interface connector (not shown), an insertion opening (not shown) for the memory card 56 and the like. The connector cable 55 is connected to the interface connector so that data can be exchanged between the interface connector and an external computer and the like. The memory card 56 is used as an expansion memory in the operation of the ink jet printer 41 and, in some other cases, the font thereof is stored and it is used when recording.

On the other hand, the upper case 43 includes the paper tray 47 from which recorded sheets of paper can be discharged. The upper case 43 also includes the panel console 48 in which there are disposed input means to be used frequently by users for various purposes such as setting of a record mode, paper feed, paper discharge and the like, display means for displaying messages sent from the printer side, and other means. The upper case 43 further includes the hand insertion opening 49 and hand insertion tray 50, from which the users can feed the paper by hand.

Moreover, the ink cartridge insertion cover 51 is provided in the upper case 43. If the cover 51 is opened, then the ink cartridge 52 disposed within the upper case 43 can be removed or installed. The ink cartridge 52 is an ink supply device according to the invention which has been illustrated in the above respective embodiments.

The ink cartridge 52, as shown in FIG. 14, is removably held by the carriage 61. The carriage shown in FIG. 14 is divided by the partition walls 64 into a number of sections corresponding to the number of ink cartridges to be loaded. In the illustrated case, the carriage 61 is divided into four so that four ink cartridges 52 can be loaded into the carriage 61. The ink cartridge 52 is inserted with the head 70 located down. In this insertion, the engaging projection 71 of the ink cartridge 52 is engaged with the engaging groove 67 of the carriage 61. And, the ink cartridge 52 is fixed by the lock mechanism 66. The lock mechanism 66 can be formed of an eccentric cam disk or the like and, by rotationally moving a lever, the ink cartridge 52 can be pushed in a direction of an arrow X2 shown in FIG. 14 so that it can be fixed. In FIG. 14, the lock mechanism 66 of the frontmost slot is removed and the front wall surface is in part broken away.

The connecting board 72 is interposed between the rear wall 65 and partition wall 64 of the carriage 61. In the connecting board 72, there are mounted electronic parts such as an IC and the like which are electrically connected with the substrate of the main body of the carriage 61 by means of a flexible cable or the like. Also, in the connecting board 72, there are arranged the connecting terminals 73 which respectively correspond to the ink cartridges 52. If the ink cartridge 52 is inserted and is pushed in the X2 direction by the lock mechanism 66, then the terminal (not shown) of the ink cartridge 52 and the connecting terminal 73 are electrically connected with each other.

Also, the carriage 61 includes the screw shaft through hole 62 and guide shaft through hole 63 through which the screw shaft 68 and guide shaft 69 extend respectively. The screw shaft 68 is rotatably supported through a bearing and it can be rotationally driven by a drive mechanism (not shown). Also, the guide shaft 69 is fixed to the main body such that it is arranged in parallel to the screw shaft 68. With the rotational movement of the screw shaft 68, the carriage 61 is moved horizontally in a direction of Y1 or Y2 in FIG. 14. In this movement, the cartridge 61 slides along the guide shaft 69.

Two or more sheets of paper stored in the paper tray 54 are taken out and delivered sheet by sheet by a delivery system (not shown) in such a manner that they are moved along the circumference of the paper feed roller 53. The screw shaft 68 and guide shaft 69 are arranged in parallel to the paper feed roller 53 shown in FIG. 13, and the carriage 61 moves perpendicularly to the paper delivering direction and records every belt-like areas respectively corresponding to the recording width of the record head 70. And, the paper feed roller 53 feeds the paper in the longitudinal direction of the paper up to the recording position of the next belt-like area. By performing these operations repeatedly, recording on the paper can be achieved. After recorded, the paper is discharged out to the paper tray 47 of the upper case 43.

The ink jet printer shown in FIGS. 13 and 14 is just an example to which the present ink supply device can be applied and, of course, the present invention can also be applied to other various ink jet printers having different structures including a structure using only one record head, a structure in which paper is fixed and a record head is moved in the X, Y directions, and the like.

As can be understood clearly from the foregoing description, according to the invention, there is provided a meniscus forming portion and the meniscus forming portion is always kept wet with liquid by a liquid guide portion, whereby a negative pressure within an ink chamber can be maintained in an almost constant level by the meniscus of the liquid and thus ink within the ink chamber can be stably supplied to a record head. Also, according to a structure including a sub-ink chamber in which an ink absorbing member is disposed, even the environment changes, the negative pressure within the ink chamber can be always kept in an almost constant level. Further, according to a structure in which the liquid guide porion is arranged to extend to various portions of a main ink chamber, the negative pressure within the ink chamber can be kept almost constant regardless of the attitudes of the ink supply device.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink supply device for use in an ink jet printer which supplies ink to a recording head, said ink supply device comprising:

a main ink chamber for hermetically sealing and storing therein ink supplied to the recording head, said main ink chamber having an ink supply port disposed at a lower portion thereof;

a sub-ink chamber disposed above said main ink chamber, connected in communication with said main ink chamber through a communication hole and further including an air communication port;

an ink absorbing member disposed within said sub-ink chamber;

a meniscus film forming member disposed to cover said communication hole of said sub-ink chamber and including a plurality of minute holes which communicate an interior of said main ink chamber with an interior of said sub-ink chamber, said meniscus film forming member having a first surface facing the interior of said main ink chamber and an opposite second surface; and an ink guide member for supplying said ink stored in said main chamber to said meniscus film forming member, said ink guide member extending into a lower portion of said main chamber so as to contact said ink stored therein and also being in contact with a part of the first surface of said meniscus film forming member, that portion of said ink guide member which is in contact with said meniscus film forming member having a sectional area smaller than the area of said first surface said ink guide member being formed of a material that can conduct said stored ink by capillary action to said meniscus film forming member;

wherein the second surface of said meniscus film forming member is in contact with said ink absorbing member, and as said ink in said main ink chamber is consumed a differential pressure between the first and second surfaces of the meniscus film forming member causes gradual expansion of a liquid meniscus film on said meniscus film forming member into said main ink chamber in accordance with an increase of the differential pressure until the liquid meniscus film becomes an air bubble and so that air in the bubble is introduced into the main ink chamber, thereby maintaining a negative pressure in said main chamber at a constant level.

2. An ink supply device as set forth in claim 1, further including a nozzle provided in said record head and positioned below a liquid surface of said ink stored in said main ink chamber, the nozzle having a leading end portion from which ink is ejected, and wherein said a plurality of minute holes of said meniscus film forming member are formed in such a manner that the sum of (a) an interfacial tension in a boundary surface between ink forming said liquid meniscus film and of a meniscus film formed by said ink in said meniscus film forming member and (b) an ink pressure head caused by a height difference between said nozzle and said surface is smaller than a surface tension of ink existing in the leading end portion of said nozzle.

3. An ink supply device as set forth in claim 1, wherein said meniscus film forming portion is formed of a mesh-like member having a twilled Dutch weave structure.

4. An ink supply device as set forth in claim 1, wherein a peripheral portion is in the said first surface of said meniscus film forming member is not in contact with said meniscus film forming member so as to provide a section in which air bubbles can be produced.

5. An ink supply device as set forth in claim 1, wherein said ink guide member comprises a plurality of members contacting a bottom of said main ink chamber.

6. An ink jet printer for printing by supplying ink to a recording head, comprising an ink supply device as claimed in any one of claims 1 and 3–5.

7. An ink supply method used in an ink supply device having a hermetically sealed ink chamber for storing ink therein, the ink chamber having an ink supply port disposed at a lower portion thereof and a meniscus film forming member for forming a liquid meniscus film, the meniscus film forming member disposed in part of an upper wall of said ink chamber, having a first surface and a second surface opposite from the first surface, and having a plurality of minute holes which communicate an interior of said ink chamber with an exterior thereof, the method comprising the steps of:

introducing ink into said chamber and forming a liquid meniscus film on said member meniscus film forming;

exposing a first surface of said liquid meniscus film to ambient pressure of said ink supply device;

exposing a second surface of said liquid meniscus film to air above the ink in said ink chamber;

supplying the ink from said ink chamber, so as to gradually expand said liquid meniscus film into a shape projecting into the air within the interior of said ink chamber in accordance with an increase of differential pressure acting on the first surface of said liquid meniscus film until said expanded film turns into a bubble containing air therein; and introducing into said ink chamber the air contained in the bubble entering said ink chamber and forming the original liquid meniscus film shape to reduce said differential pressure in said ink chamber and form the meniscus film on said meniscus film forming member to hermetically seal said ink chamber, and maintaining a negative pressure in the interior of said ink chamber at a constant level.

* * * * *